US007128530B2

(12) United States Patent
Anguisola McFeat et al.

(10) Patent No.: US 7,128,530 B2
(45) Date of Patent: Oct. 31, 2006

(54) COOLABLE COMPONENT

(75) Inventors: Jose Ma Anguisola McFeat, Zürich (CH); Werner Balbach, Wuerenlingen (CH)

(73) Assignee: ALSTOM Technology Ltd, Baden (CH)

( * ) Notice: Subject to any disclaimer, the term of this patent is extended or adjusted under 35 U.S.C. 154(b) by 150 days.

(21) Appl. No.: 10/992,789

(22) Filed: Nov. 22, 2004

(65) Prior Publication Data

US 2005/0118024 A1 Jun. 2, 2005

Related U.S. Application Data

(63) Continuation of application No. PCT/EP03/50162, filed on May 14, 2003.

(30) Foreign Application Priority Data

May 22, 2002 (CH) ..... 2002 0850/02

(51) Int. Cl.
*F01D 5/18* (2006.01)

(52) U.S. Cl. ..... 416/2; 416/97 A; 416/97 R

(58) Field of Classification Search ..... 415/115, 415/116, 121.2, 9; 416/2, 97 R, 97 A, 96 A, 416/224
See application file for complete search history.

(56) References Cited

U.S. PATENT DOCUMENTS

| | | | | |
|---|---|---|---|---|
| 4,820,122 | A | 4/1989 | Hall et al. | 146/97 R |
| 4,992,025 | A * | 2/1991 | Stroud et al. | 416/97 R |
| 6,308,511 | B1 | 10/2001 | Beeck et al. | 60/39.02 |
| 7,052,233 | B1 * | 5/2006 | Fried et al. | 415/121.2 |

FOREIGN PATENT DOCUMENTS

DE 198 34 376 A1 2/2000

* cited by examiner

*Primary Examiner*—Edward K. Look
*Assistant Examiner*—Dwayne J White
(74) *Attorney, Agent, or Firm*—Steptoe & Johnson LLP

(57) ABSTRACT

Throughflow openings are provided for a cooling medium in a coolable component. The throughflow opening comprises an insert that reduces the size of the first opening cross-section to a second opening cross-section, and that is released from the first opening if the second opening cross-section becomes blocked as a result of a local temperature rise and a thermally unstable joining between the insert and the component, being mounted in a first opening. The present throughflow opening greatly reduces the risk of damage to components to be cooled, in particular turbine blades, as a result of fine throughflow openings becoming blocked.

20 Claims, 2 Drawing Sheets

COOLABLE COMPONENT

CROSS-REFERENCE TO RELATED APPLICATIONS

This application is a continuation of the U.S. National Stage designation of co-pending International Patent Application PCT/EP03/50162 filed May 14, 2003, the entire content of which is expressly incorporated herein by reference thereto.

FIELD OF THE INVENTION

The present invention relates to a coolable component. It also relates to a method for producing a component according to the invention.

BACKGROUND OF THE INVENTION

In the field of continuous flow machines, in particular gas turbines in installations for power generation or in aviation, increasingly high turbine inlet temperatures of the hot gas are being strived for and achieved in order to increase the power. However, these higher temperatures present a problem for the integrity of those turbine components which are loaded by high temperatures, in particular the turbine blades. The inlet temperatures to the first turbine stage in modem gas turbines are already higher than the melting point of the blade material. In order to prevent damage to the turbine blades caused by these high operating temperatures, the blade components are cooled via cooling channels running within the blades.

One known cooling method for cooling gas turbine blades is internal, convective cooling. In this cooling technique, which is illustrated schematically in FIG. 1, cooling air is introduced into the blade root through the rotor shaft, from where it is carried in cooling channels which run within the blade itself, in which cooling channels it absorbs the heat from the turbine blade. The heated cooling air is, finally, blown out of the turbine blade through suitably arranged holes and slots. So-called impingement cooling and film cooling are generally used in conjunction with this convective cooling. In the case of impingement cooling, the cooling air strikes the inner face of the wall of the turbine blade through small throughflow openings, while, in the case of film cooling, it is passed to the outer surface of the turbine blade through small throughflow openings, where it forms a thin cooling air film. The cooling air for cooling the turbine blades is generally taken from the compressor stage, with a portion of the compressed air being tapped off and being passed to the respective continuous flow machine components to be cooled, for cooling purposes.

Adequate and reliable cooling of components of a continuous flow machine represents a major aspect of their operation. Modem high-temperature gas turbines require a cleverly designed cooling system, in particular for cooling the highly loaded turbine blades, in order to achieve high efficiency. However, during operation of a cooling system such as this in a continuous flow machine, problems can occur with the cooling channels or cooling air holes becoming blocked by dirt or dust particles, which can originate from the atmosphere or from components of the continuous flow machine located upstream of the cooling channels, and which can be introduced into the cooling channels with the cooling medium. Because the minimum cooling medium mass flow is no longer maintained, blocking of individual cooling channels or cooling air holes can lead to a considerable local temperature load on the component to be cooled, with the component possibly becoming damaged.

There are numerous measures for preventing cooling air holes in continuous flow machines from becoming blocked. By way of example, it is known in order to reduce or to avoid the risk of blocking for dust extractors, such as cyclones, to be arranged within the cooling circuit, which separate dirt or dust particles from the cooling medium. Vortices are produced in the cooling medium in these dust extractors, by means of which the dust and dirt particles are separated from the cooling medium by virtue of their inertia, and are removed from the cooling medium via a separate dust extraction opening.

The use of a dust extractor such as this in the form of an axial cyclone is disclosed, for example, in DE 198 34 376 A1. The cooling air coming from the compressor stage is in this case passed through the axial cyclone before it enters the first guide vane of the turbine stage. A spin generator is formed in the axial cyclone, which produces a vortex in the cooling air, on the basis of which the more inert dirt and dust particles strike the wall of the axial cyclone, from where they are deposited. They are extracted via appropriate extraction channels at the base of the cyclone.

In a further technique, which in some cases is used in conjunction with dust extractors, specific dust extraction openings are provided in the cooling channels within the turbine blade, from which relatively large dust or dirt particles emerge as a result of their inertia. One example of the arrangement of dust extraction openings such as these in the cooling channels is disclosed, for example, in U.S. Pat. No. 4,820,122.

Despite the measures implemented so far, it is, however, not possible to completely preclude the possibility of dust or dirt particles entering the cooling channels of the component to be cooled as far as narrow throughflow openings for the cooling medium, and for these throughflow openings to become blocked.

SUMMARY OF THE INVENTION

It is, according to an aspect of the invention, intended to disclose a coolable component avoiding the disadvantages of the prior art. According to another aspect of the invention, it is more specifically intended to disclose a throughflow opening for the cooling medium, which is less susceptible to such blocking by dust or dirt particles, and, accoding to yet another aspect, to disclose a manufacturing method which is suitable for production of a throughflow opening such as this in a coolable component.

Disclosed is thus the coolable component and the method for production of the component. Exemplary embodiments of the component and of the manufacturing method can be found in the specification.

The coolable component has a throughflow opening for a cooling medium which, first of all, is formed in a manner known per se by a first opening with a first opening cross-section in a component composed of a first material. The essence of the invention is to arrange an insert in the first opening, which insert reduces the size of the cross-section of the throughflow hole to a second throughflow cross-section. In this case, in general, the second opening cross-section is the nominal value of the opening cross-section. In this case, a thermally unstable joining, which is released when a limit temperature is exceeded, is produced between the insert and the basic material of the component, expediently at the boundary surface between the insert and the interior of the first opening. The thermally unstable joining can be produced by introducing the material of the insert, for example a Bondcoat material and/or TBC material, directly into the first opening, where it adheres, with the adhesion force between the two materials as a function of the temperature, and falling below the value that is required for the insert to be securely seated in the first opening when the temperature falls below the limit temperature. A further option is to use a thermally unstable material, for example an adhesive or a solder which becomes soft at high temperature and cannot maintain the joining, to produce the joining, in particular in a joint gap between the insert and the component. Furthermore, the insert also could be inserted in an oversize form into the opening, so as to produce a push fit, in which case instability of the joining can be achieved in a simple manner by appropriate choice of the thermal coefficients of expansion of the material of the component and of the material of the insert.

The thermally unstable joining and/or the insert are/is preferably composed of a material that oxidizes in the cooling medium and whose oxides vaporize at the desired temperature, with the oxides that are formed being, in particular, oxides from the chromium oxide, molybdenum oxide and tungsten oxide series.

The thermally unstable joining may, however, also be composed of a material that is above its melting point at the desired temperature, with the thermally unstable joining containing, in particular, metals from the Ag, Cu, Au, Al, Zn, Cd, In, Tl, Ge, Sn, Pb, Sb and Bi series individually or in conjunction with one another.

Furthermore, it is feasible for the thermally unstable joining to contain wood metal, soft solder, hard solder such as brass solder, nickel silver solder, silver solder, aluminum silver solder, B-Cu55ZnAg or nickel-based solder with silicon on its own and/or with boron, or for the thermally unstable joining to contain glass solder, in particular high-lead glass, composite solder with a codierite additive, or solder glass.

However, it is also feasible for the thermally unstable joining and/or the insert to be composed of a material that fails when its creep strength is exceeded, with the material being, in particular, a silver copper tin solder or an austenitic steel.

The thermally unstable joining and/or the insert may likewise be composed of a material that fails when the softening temperature is exceeded, with the material being, in particular, a self-flowing NiCrFeSiB corrosion protection layer.

Finally, it is feasible for the thermally unstable joining and/or the insert to be composed of a material that has a low thermal coefficient of expansion and that fails as a result of stresses that occur and as a result of its brittleness when thermally overloaded. In this case, the material is preferably a ceramic, in particular $SiN_4$, unstabilized or partially stabilized $ZrO_2$, or a glass.

One suitable method for introduction of a throughflow opening for a cooling medium according to the invention into a coolable component is, first of all, to introduce a first opening with a first opening cross-section into the component, for example by drilling this first opening. In a next step, a Bondcoat material and/or a TBC material, for example, are/is applied so as to essentially seal the opening. Finally, the throughflow opening with the second opening cross-section can be incorporated in the material introduced for closing purposes.

The method of operation of the invention is now as follows: heat is introduced into the component from at least one side. A cooling medium flowing out through coolant throughflow openings absorbs heat from the component. The second opening cross-section in the insert in a throughflow opening is of such a size that, during normal operation without any disturbances, a minimum required coolant mass flow flows through this opening, which is sufficient to keep the material temperature in the immediate vicinity of the throughflow opening below the limit temperature.

If the second opening cross-section becomes blocked by a dust or dirt particle, this leads to a reduction in the coolant mass flow below the minimum required level. In consequence, the temperature at the cooling point rises, and/or the pressure drop across the insert in the throughflow opening rises. If the limit temperature is exceeded, the thermally unstable joining is released in such a way that the insert, together with the blocking particle, is finally released from the throughflow opening, which is opened up for the cooling medium to flow through. After this event, the first opening cross-section admittedly results in a somewhat larger opening cross-section remaining than the nominal cross-section, but the further cooling of the corresponding point on the component is ensured.

Bonding agents (Bondcoat), TBC materials (Thermal Barrier Coating) or else paint test materials as used in gas turbine technology may be used, for example, as suitable materials for the insert. Other materials that have these temperature-dependent characteristics and have also been specifically developed for this application, of course, also may be used.

The mechanism that leads to the insert being released from the hole may be based on various physical characteristics. Thus, for example, the melting point of the second material that is selected for the insert may correspond to the limit temperature. The second material also may be subject to mechanical stress on reaching the limit temperature, such that it shatters above this temperature. The significant factor with this embodiment is in any case that the joining between the insert and the hole is released above the limit temperature, so that the insert is removed from the hole, together with the particle blocking it. In this case, there is no need for an increased pressure drop on the hole in each case. In fact, the pressure drop that occurs during normal operation without any blocking at the insert may be sufficient.

In a further embodiment, the temperature dependency of the second material is not absolutely essential. In this embodiment, the adhesion between the insert and the hole is chosen such that it no longer withstands the applied pressure resulting from the greater pressure difference on the insert that occurs in the event of blocking, so that the insert is released from the hole.

The refinement of coolant throughflow openings according to the invention is suitable for components of continuous flow machines, in particular as cooling air outlet openings for film or impingement cooling in turbine blades. A throughflow opening designed in this way, of course, also may be used in other fields in which blocking of the throughflow openings may have undesirable consequences.

BRIEF DESCRIPTION OF THE DRAWINGS

The present invention will be explained once again briefly in the following text using an exemplary embodiment and in conjunction with the drawings, in which.

DETAILED DESCRIPTION OF THE PREFERRED EMBODIMENTS

Figure 1A:
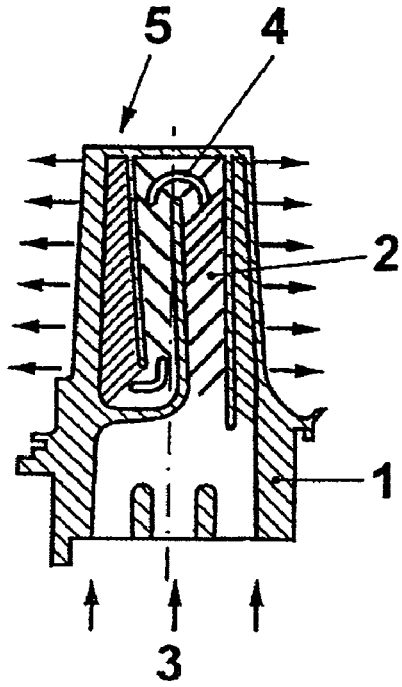
FIG. 1 shows an example of the profile of cooling channels in a turbine blade, in two different views.

FIG. 1 shows, schematically, two different views of the design of a turbine blade with cooling channels running in it. The section view in FIG. 1*a* shows the rotor-side inlet 3 for the cooling medium into the turbine blade. The cooling air flowing in is indicated by the three arrows. Within the turbine blade 1, the cooling air is passed via corresponding cooling channels 2 as far as the leading edge and trailing edge of the turbine blade, at which the cooling air emerges via throughflow openings, as is likewise indicated by the arrows in the figure. A dust extraction opening 5 is generally formed in the area of the cooling channel bend 4 at the blade tip of the turbine blade 1, through which particles carried with the cooling medium emerge from the turbine blade, by virtue of their inertia. This dust extraction opening is intended to prevent the undesirable larger particles from reaching as far as the fine throughflow openings at the leading edge or trailing edge of the turbine blade, and blocking the throughflow openings there.

Figure 1B:
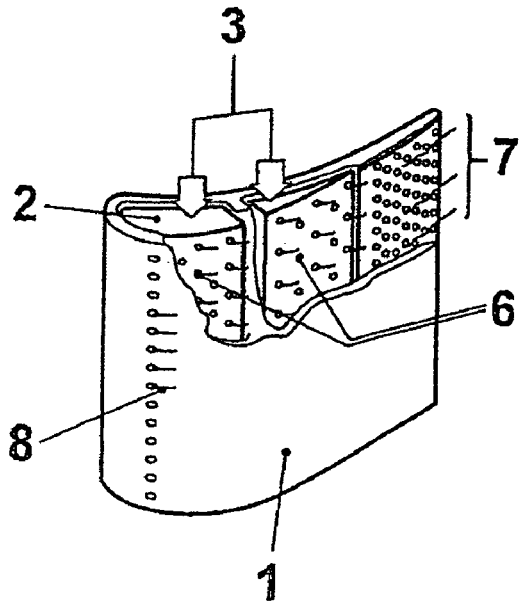

FIG. 1*b* shows the schematic configuration of the turbine blade, once again, in the form of a perspective view. In this view, the cooling air entering the cooling channels 2 is once again indicated by the two block arrows. The cooling air emerges from the cooling channels via the throughflow openings 6 for impingement cooling, and strikes the outer shell of the turbine blade from the inside, in order to cool it. The cooling air is then passed on via cooling pins, so-called cold pins 7, to the trailing edge of the turbine blade, where it emerges. The figure also shows the throughflow openings 8 for film cooling of the outer face of the turbine blade, via which a portion of the cooling air likewise emerges from the cooling channels 2.

Owing to the very small opening cross-section of the throughflow openings 6, 8 for impingement cooling and for film cooling, there is a risk of these throughflow openings becoming blocked by dust or dirt particles that are carried with the cooling medium, in general the cooling air. Despite upstream dust extractors as well as dust extraction openings 5 arranged in the cooling channel 2 within the turbine blade 1, the risk of a blockage cannot be completely precluded. If a blockage such as this occurs, this leads to a considerable temperature load, however, at the corresponding cooling point, which can even lead to damage to the corresponding component.

The design of the throughflow openings according to the invention makes it possible to considerably reduce the risk of damage to the component to be cooled when the throughflow openings become blocked.

Figure 2:
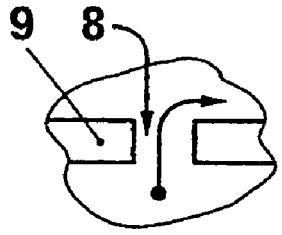
FIG. 2 shows an example of the normal design of a throughflow opening in a component to be cooled.

FIG. 2 shows, schematically, the typical design of a throughflow opening 8 for a cooling medium, which is surrounded by the material of the component to be cooled, in this case by the metal 9 of the blade itself. This also could be a dust extraction opening, in the same way.

Figure 3:
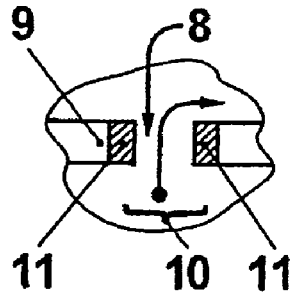
FIG. 3 shows an example of the design of a throughflow opening in a component to be cooled, according to the present invention.

The throughflow opening according to the present invention in contrast has a first opening as well as an insert, which is arranged in the first opening and has a second opening cross-section, as can be seen from the schematic illustration in FIG. 3. A first opening, the hole 10 in the throughflow opening 8, is bounded by the metal 9 of the blade itself. An insert 11 is mounted within the first opening 10 in the blade itself, and is formed from a filling material which is, for example, temperature-dependent. The opening cross-section of the throughflow opening 8, which has been reduced in size by this insert, corresponds to the opening cross-section provided in a typical throughflow opening, as is shown in FIG. 2.

Figure 4:
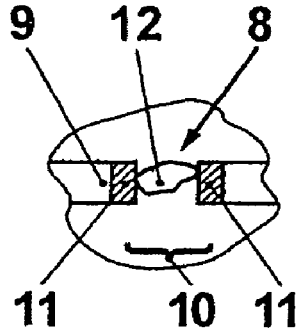
FIG. 4 shows the state in which a throughflow opening as shown in FIG. 3 is blocked.
Figure 5:
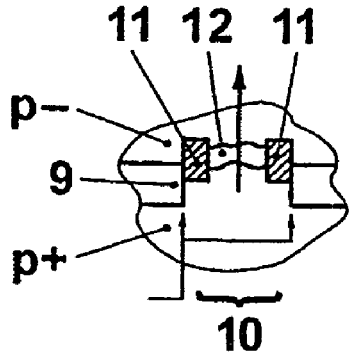
FIG. 5 shows the state of the throughflow opening shown in FIG. 4 after a short time.

If this throughflow opening 8 now becomes blocked with a dust particle 12 during operation, as is illustrated schematically in FIG. 4, then the film cooling is interrupted at this point, so that the turbine blade 1 is heated more severely in the vicinity of the throughflow opening 8. In consequence, the temperature at the junction point between the insert 11 and the metal 9 of the blade likewise rises. On reaching a specific limit temperature, the insert 11 is then released from the hole 10, as is illustrated in FIG. 5, since the joining between the insert and the component is thermally unstable.

Figure 6:
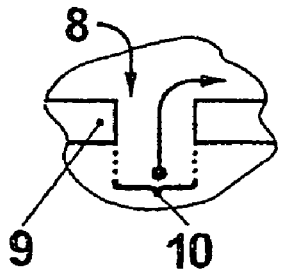
FIG. 6 shows the state of the throughflow opening shown in FIG. 4 after the insert has been released.

The material of the insert 11 is chosen such that the adhesion between the metal 9 of the blade and the material of the insert 11 decreases sharply, or disappears completely, above a raised temperature, which is not reached during normal cooling but does occur after a blockage. The pressure difference in the pressure upstream and downstream of the throughflow opening 8 then leads to the insert being removed together with the dust particle 12 contained in it, so that the throughflow opening 8 is then once again free (FIG. 6). After the insert 11 has been released, the throughflow opening 8 admittedly has a larger cross-section—corresponding to that of the first opening 10—but this prevents the risk of the component to be cooled being damaged by the blockage.

The following materials may be used in particular as thermally unstable materials for the joining between the insert 11 and the metal 9 of the blade, and for the insert 11 itself:

Materials may be used which oxidize in the cooling medium (depending on the temperature) and whose oxides vaporize at a specific temperature, such as chromium oxide above 900° C., molybdenum oxide and tungsten oxide above 600° C. These materials may be used both for the joining and for insert itself.

Materials may be used which exceed their melting point (as pure elements or as compounds), such as silver which melts at 960° C., copper which melts at 1083° C., or gold which melts at 1063° C. or, if necessary, also Al, Zn, Cd, In, Tl, Ge, Sn, Pb, Sb and Bi which cover the range from 660° C. down to 156° C. in the pure state, but which can be set to virtually any desired melting point in conjunction with one another and with other elements (wood metal 60° C. to soft solders whose Ta is <450° C. and hard solders whose Ta is >450° C. (brass solders, nickel silver solders, silver solders, aluminum silicon solders, which cover the range up to more than 800° C., B-Cu55ZnAg whose Ta is 830° C.). Nickel-based solders with silicon on its own and/or with boron, whose melting points can also be changed (increased) by diffusion under the influence of temperature and time and materials, cover the temperature range up to 1200° C. If an increased temperature load actually occurs during installation of the blade, then the joining will fail at the operating temperature of the solder and the amount of cooling is increased, while, if an increased temperature occurs only after a delay, then the joining fails only at a higher temperature compared to the solder temperature. If it is not desirable for elements to diffuse away then, for example, instead of the boron variant, it is also possible to use a silicon variant with reduced diffusion. If the aim is to keep the melting point of the solder low in the long term, then high-temperature solders with diffusion blocks should be used. Glass solders, such as high-lead glasses with a solder temperature of 400 to 500° C., composite solders, inter alia with a codierite additive, and solder glasses may likewise be used, depending on the requirement.

Materials may be used which fail owing to their creep strength being exceeded, such as silver copper zinc solders above 300° C., or austenitic steels above 600° C.

Materials may be used which fail owing to their softening temperature c being exceeded, for example in the case of self-flowing NiCrFeSiB corrosion protection layers, from which the inserts can be produced.

Materials with low thermal coefficients of expansion may be used and which fail when thermally overloaded owing to the stresses that occur and their brittleness, such as ceramics ($SiN_4$, $ZrO_2$ unstabilized or partially stabilized, glasses).

The above list is intended to illustrate examples, and is not exclusive.

LISTOF DESIGNATIONS

1 Turbine blade
2 Cooling channels
3 Rotor-side inlet
4 Cooling channel bend
5 Dust extraction opening
6 Throughflow openings for impingement cooling
7 Cooling pins
8 Throughflow openings, in particular for film cooling
9 Metal of the blade
10 Hole in the throughflow opening, first opening
11 Insert
12 Dust particle

What is claimed is:

1. A coolable component comprising:

a throughflow opening for a cooling medium comprising a first opening in the component having an inner surface defining a first cross-sectional area;

an insert disposed in the first opening, the insert defining a second opening with a second cross-sectional area smaller than the first cross-sectional area;

wherein the insert is joined to the component in a manner that provides a thermally unstable joining that is adapted to release when material of the component proximate the joining exceeds a limit temperature;

wherein an increased cross-sectional area of the throughflow opening is provided when the insert is released from the first opening.

2. The coolable component of claim 1, wherein the insert comprises a coating layer and adhesion of the coating layer on the first opening is temperature-dependent.

3. The coolable component of claim 1, wherein the insert is joined to the component by a bonding material that is thermally unstable.

4. The coolable component of claim 3, wherein the bonding material is arranged as a layer between the insert and the component.

5. The coolable component of claim 3, wherein the bonding material is selected from the group consisting of an adhesive and a solder.

6. The coolable component of claim 1, wherein the second opening is configured and dimensioned to provide a minimum coolant mass flow through the second opening so that sufficient cooling is provided to the component.

7. The coolable component of claim 1, wherein:

the limit temperature is selected in adapting and configuring the thermally unstable joining;

the limit temperature is selected such that material of the component is maintained at a temperature below the limit temperature during operation on at least a lower limit coolant mass flow; and when the limit temperature is reached or exceeded when mass flow of the cooling medium falls below the lower limit coolant mass flow, the joining becomes unstable and the insert is released so that the cooling medium flows in the first cross-sectional area.

8. The coolable component of claim 1, wherein the insert consists of at least one of a Bondcoat material and a TBC material.

9. The coolable component of claim 1, wherein the thermally unstable joining comprises a material that oxidizes in the cooling medium and whose oxides vaporize at the limit temperature.

10. The coolable component of claim 9, wherein the oxides are selected from the series consisting of chromium oxide, molybdenum oxide and tungsten oxide.

11. The coolable component of claim 1, wherein the thermally unstable joining comprises material with a melting point at the limit temperature.

12. The coolable component of claim 11, wherein the material is selected from the series of metals consisting of Ag, Cu, Au, Al, Zn, Cd, In, Tl, Ge, Sn, Pb, Sb and Bi, and wherein the material is used in a pure condition or in conjunction with another of said series.

13. The coolable component of claim 12, wherein the material is selected from the group consisting of wood-metal, soft solder, hard solder, brass solder, nickel silver solder, silver solder, aluminum silver solder, B-Cu55ZnAg, nickel-based solder with silicon, and combinations thereof.

14. The coolable component of claim 13, wherein the material further comprises boron.

15. The coolable component of claim 11, wherein the thermally unstable joining comprises at least one selected from the group consisting of glass solder, high-lead glass, composite solder with a codierite additive, and solder glass.

16. The coolable component of claim 1, wherein the component is a component of a fluid flow machine.

17. The coolable component of claim 1 wherein the insert is joined to the inner surface of the first opening.

18. A method for producing a coolable component with a throughflow opening for a cooling medium, the method comprising:

producing a first opening having a first cross-sectional area in the component;

disposing an insert proximate an inner surface of the first opening;

joining the insert to the component in a thermally unstable manner in the first opening, the insert defining a second opening providing a second cross-sectional area smaller than the first cross-sectional area, so that the throughflow opening has a reduced throughflow cross-section when the insert is joined to the component.

19. The method of claim 18, further comprising completely closing the first opening by joining the insert to the component and producing an opening with the second cross-sectional area in the insert.

20. The method of claim 18, further comprising coupling a thermally unstable material onto at least one selected from the group consisting of the inner surface of the first opening and the insert, and successively joining the insert to the component.

* * * * *